US008555753B2

(12) United States Patent
Price

(10) Patent No.: US 8,555,753 B2
(45) Date of Patent: Oct. 15, 2013

(54) STRAP WRENCH

(76) Inventor: David E. Price, Miami, OK (US)

( * ) Notice: Subject to any disclaimer, the term of this patent is extended or adjusted under 35 U.S.C. 154(b) by 733 days.

(21) Appl. No.: 12/687,224

(22) Filed: Jan. 14, 2010

(65) Prior Publication Data

US 2011/0167964 A1 Jul. 14, 2011

(51) Int. Cl.

| | |
|---|---|
| ***B25B 13/52*** | (2006.01) |
| ***B25B 7/12*** | (2006.01) |
| ***B25B 7/04*** | (2006.01) |

(52) U.S. Cl.

USPC ..... 81/64; 81/361; 81/362; 81/363; 81/364; 81/365; 81/366; 81/367; 81/368; 81/65.4

(58) Field of Classification Search

USPC ..... 81/64, 65.4; 411/113

See application file for complete search history.

(56) References Cited

U.S. PATENT DOCUMENTS

| | | | | |
|---|---|---|---|---|
| 689,325 | A | 12/1901 | Sands | |
| 840,496 | A | 1/1907 | Justen | |
| 1,347,764 | A * | 7/1920 | Shirley | 81/64 |
| 1,512,014 | A | 10/1924 | Bryar | |
| 1,525,358 | A | 2/1925 | Bergen | |
| 1,925,970 | A * | 9/1933 | Pennington | 81/57.17 |
| 2,498,582 | A | 2/1950 | Schoenberger | |
| 2,718,166 | A | 9/1955 | Hollenbeck | |
| 2,995,965 | A | 8/1961 | Hockney | |
| 3,728,916 | A | 4/1973 | Brantley | |
| 3,962,936 | A | 6/1976 | Lewis | |
| 4,114,481 | A | 9/1978 | Kowalczyk | |
| 4,221,140 | A | 9/1980 | Bracey et al. | |
| 4,345,494 | A | 8/1982 | Aamodt | |
| 4,506,568 | A | 3/1985 | Aamodt | |
| 4,532,833 | A | 8/1985 | Downs | |
| D289,363 | S | 4/1987 | DeRaad | |
| 4,697,968 | A * | 10/1987 | Veronesi | 411/113 |
| 4,860,617 | A | 8/1989 | Robbins | |
| D307,101 | S | 4/1990 | Anderson | |
| 4,916,993 | A | 4/1990 | Siekawitch | |
| 5,115,700 | A | 5/1992 | Kaler, II | |
| 5,458,027 | A | 10/1995 | Rambin | |
| 6,789,450 | B1 | 9/2004 | Helfet | |
| 7,155,999 | B1 | 1/2007 | Helfet | |
| 2008/0047398 | A1 * | 2/2008 | Buchanan | 81/65.4 |

* cited by examiner

*Primary Examiner* — Monica Carter
*Assistant Examiner* — Danny Hong
(74) *Attorney, Agent, or Firm* — Martin & Associates, LLC; Derek P. Martin

(57) ABSTRACT

A strap wrench includes a strap that is a continuous loop and has notches. No portion of the strap is affixed to any portion of the wrench. The strap is placed around an object that needs to be turned such as an oil filter on an engine. A tension mechanism is then used to tighten the strap into place around the object to be turned. A ratchet mechanism engages one or more notches on the strap to prevent movement of the strap in one direction while allowing movement of the strap in the opposite direction. The combination of the notched continuous loop strap and ratchet mechanism allow the strap wrench to have a ratcheting action after the strap is tightened into place around the object to be turned.

13 Claims, 8 Drawing Sheets

STRAP WRENCH

BACKGROUND

1. Technical Field

This disclosure generally relates to tools, and more specifically relates to strap wrenches.

2. Background Art

Many different strap wrenches have been developed over the years. Most include a strap that is fixed at one end to a handle, with a loose end that is coupled to the handle once the loop of the strap is made to be a desired size. The handle generally provides leverage that tightens the strap while providing a turning bias on the object enclosed by the strap, thereby allowing known strap wrenches to be used to turn an object such as an oil filter or a pipe.

Some strap wrenches have a tendency for the strap to slip on the enclosed object as the handle is turned. Some also suffer from the loose end of the strap loosening while the handle is turned.

Some strap wrenches have been used as oil filter wrenches. Some engines have the oil filter placed in a location that provides very limited access, making the use of many conventional tools difficult. Many strap wrenches could not be used for the removal of many oil filters because they require too much room to operate effectively. Many other tools besides strap wrenches have been developed as oil filter wrenches. While some of these are effective in certain situations, many have drawbacks that prevents their use in many engine configurations.

BRIEF SUMMARY

A strap wrench includes a strap that is a continuous loop and has notches. No portion of the strap is affixed to any portion of the wrench. The strap is placed around an object that needs to be turned such as an oil filter on an engine. A tension mechanism is then used to tighten the strap into place around the object to be turned. A ratchet mechanism engages one or more notches on the strap to prevent movement of the strap in one direction while allowing movement of the strap in the opposite direction. The combination of the notched continuous loop strap and ratchet mechanism allow the strap wrench to have a ratcheting action after the strap is tightened into place around the object to be turned.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

A strap wrench includes a strap that is a continuous loop and has notches. No portion of the strap is affixed to any portion of the wrench. The strap is placed around an object that needs to be turned. A tension mechanism is then used to tighten the strap into place. A ratchet mechanism engages one or more notches on the strap to prevent movement of the strap in one direction while allowing movement of the strap in the opposite direction. The combination of the notched continuous loop strap and ratchet mechanism allow the strap wrench to have a ratcheting action after the strap is tightened into place around the object to be turned.

Figure 1:
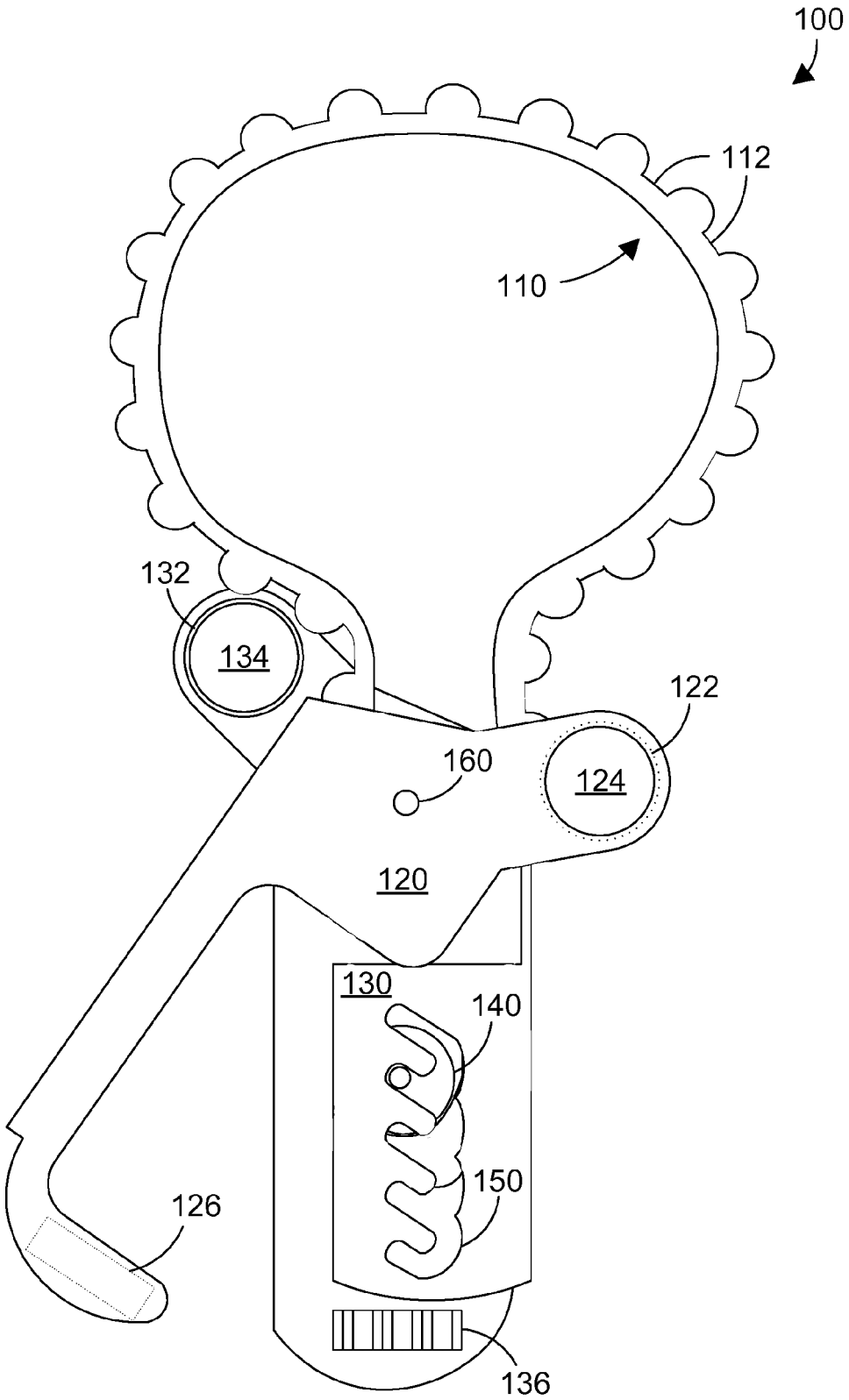
FIG. 1 is a front view of a first implementation of a strap wrench.
Figure 2:
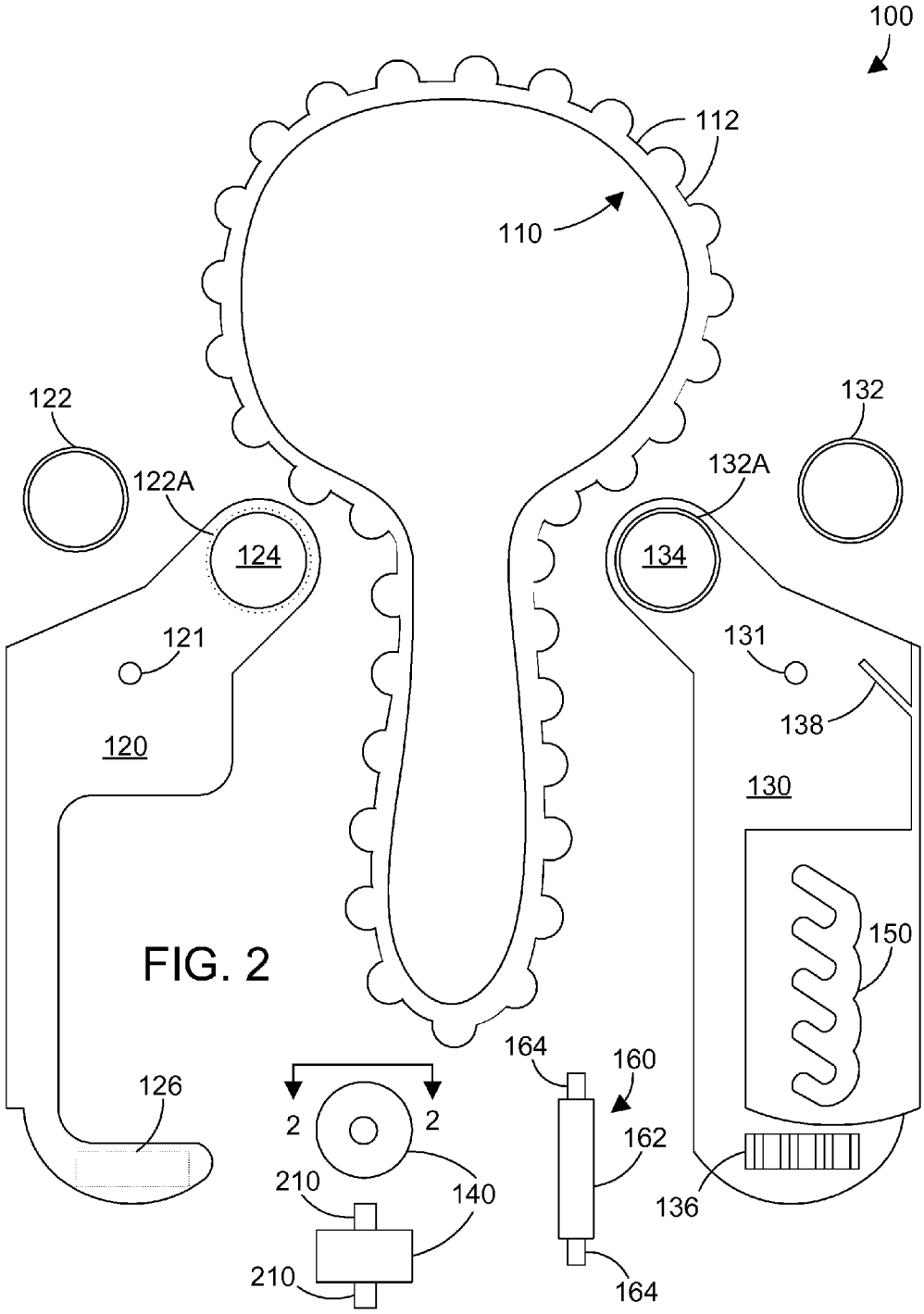
FIG. 2 is an exploded front view of the strap wrench shown in FIG. 1 showing the various components.

A first implementation 100 of the strap wrench is shown in FIGS. 1-6. A strap 110 is a continuous loop that includes a plurality of notches. Two such notches are shown as 112 in the figures. The strap wrench includes a first handle 120 pivotally coupled to a second handle 130 using a spacer 160. The spacer 160, shown in greater detail in FIG. 2, is installed with its reduced diameter ends 164 disposed in the holes 121 and 131 in handles 120 and 130, respectively, with the body 162 of spacer 160 defining the distance between handles. The spacer member 160 may be coupled to the handles 120 in any suitable way. For example, the reduced diameter portions 164 could extend above and below the handles and could be secured with push nuts. In the alternative, the reduced diameter portions 164 could be threaded to receive nuts. One of the reduced diameter portions 164 could be glued, welded or otherwise bonded to one of the handles, while the other reduced diameter portion is pivotally coupled to the opposing handle in a way that allows the opposing handle to rotate about the spacer member 160. Of course, there are numerous other ways to couple the handles 120 and 130 together that are not expressly disclosed herein. The disclosure herein expressly includes any suitable way to movably coupled the handles 120 and 130 together.

The first handle 120 includes a cylindrical recessed portion 124 that receives a bushing 122 in position 122A shown in FIG. 2. Note the bushing 122 at position 122A is underneath the handle 120, and is therefore shown at 122A and in FIG. 1 in phantom. The second handle 130 includes a cylindrical protruding portion 134 that receives a bushing 132 in position 132A shown in FIG. 2. The bushings 122 and 132 provide rollers that contact the strap 110 when the strap wrench 100 is used.

Figure 3:
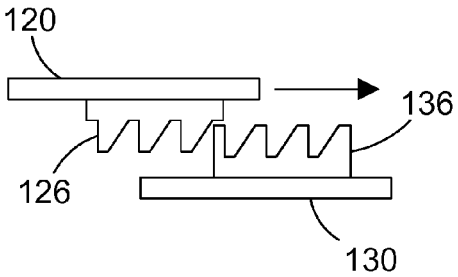
FIG. 3 is a bottom view of the strap wrench in FIG. 1 showing the first handle 120 and second handle 130 before locking the handles together.
Figure 4:
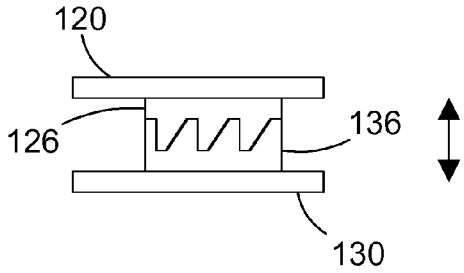
FIG. 4 is a bottom view of the strap wrench in FIG. 1 showing the first handle 120 and second handle 130 after locking the handles together.

The first handle 120 includes a first locking member 126, and the second handle 130 includes a second locking member 136. These locking members may be used to lock the handles in a closed position. This is shown in detail in FIGS. 3 and 4. FIG. 3 shows the first handle 120 placed next to the second handle 130, but not yet locked in place. When a person squeezes the two handles together, the first handle 120 will move as indicated by the arrow in FIG. 3 with respect to the second handle 130, causing the first locking member 126 to engage the second locking member 136, thereby locking the two handles 120 and 130 together as shown in FIG. 4. The handles may be easily unlocked by applying a force to separate the first handle 120 from the second handle 130, as shown by the arrows in FIG. 4. Once the first locking member 126 is no longer engaged with the second locking member 136, the handles may be moved to an unlocked position.

Figure 5:
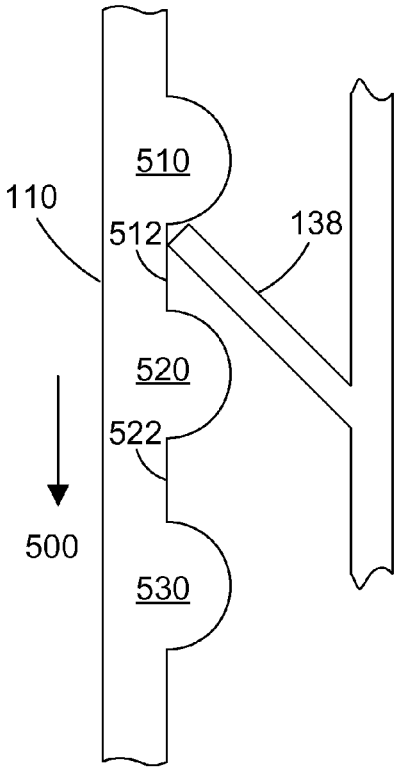
FIG. 5 is an enlarged view of the stop member 138 showing how the stop member prevents movement of the strap in a first direction.
Figure 6:
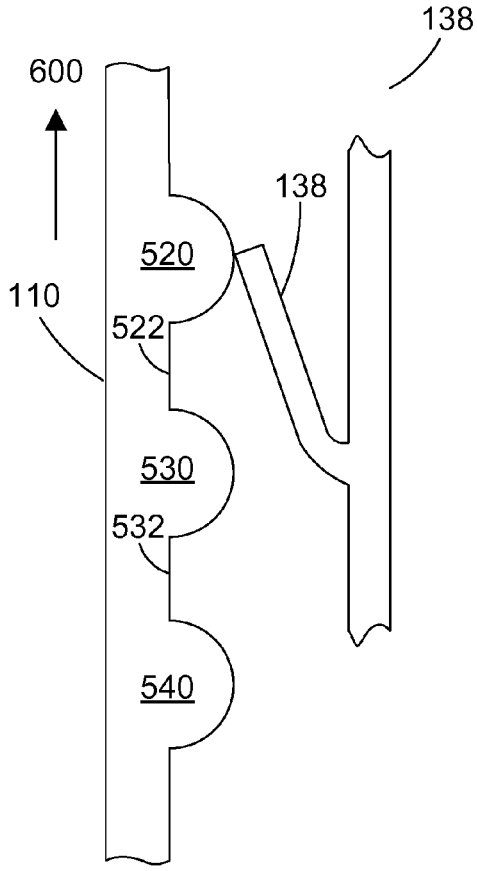
FIG. 6 is an enlarged view of the stop member 138 showing how the stop member allows movement of the strap in a second direction.

Strap wrench 100 preferably includes a ratchet mechanism. One suitable ratchet mechanism shown in FIG. 2 is a stop member 138 on handle 130. The function of the stop member is best understood with reference to FIGS. 5 and 6. The strap 510 includes multiple protrusions between the notches, some of which are shown in FIGS. 5 and 6 as 510, 520, 530 and 540. Strap 510 also includes a plurality of notches, some of which are shown in FIGS. 5 and 6 as 512, 522 and 532. The stop member 138 is positioned next to the strap 110 so the stop member 138 is within one of the notches of the strap, as shown by stop member 138 being within notch 512 in FIG. 5. The stop member 138 is disposed at an angle, which allows movement of the strap 110 in one direction but prevents movement of the strap 110 in the opposite direction. For example, referring to FIG. 5, if the wrench is turned to create a force that wants to move the strap along direction 500, the stop member 138 will engage the protrusion 510, thereby preventing movement of the strap along direction 500. However, if the wrench is turned to create a force that wants to move the strap along direction 600 in FIG. 6, the stop member 138 will bend as protrusion 520 contacts the stop member, causing the stop member 138 to move above protrusion 520 as shown in FIG. 6 as the strap 110 moves in direction 600. As the strap continues to move in direction 600, the stop member will move back to the position shown in FIG. 5, disposed in notch 522 shown in FIG. 6.

The stop member 138 thus provides a ratchet mechanism that allows the strap wrench 100 to rotate in one direction while preventing rotation in the opposite direction. With the configuration shown in FIGS. 1-6, the strap wrench may be used in one orientation to loosen an object to be turned, and may be used in a flipped orientation by rotating the strap wrench 180 degrees about its longitudinal axis to tighten the object to be turned. The ratchet mechanism provided by stop member 138 illustrates the need for a continuous loop strap that has a plurality of notches. By providing a continuous loop strap, the strap wrench 100 may be used in a ratcheting manner after the handles are locked together and the strap 100 is tightly placed around an object to be turned. This is especially useful when using the strap wrench 100 as an oil filter wrench, where room to maneuver the wrench within an engine compartment is often limited. By providing a ratchet mechanism, the strap wrench can be used in very tight places that would not accommodate other known strap wrenches.

The strap 110 shown in the figures includes a plurality of notches 112 that are substantially flat with a plurality of semi-circular protrusions between notches. One suitable continuous loop strap that could be used for the strap wrenches disclosed herein is a timing belt for a car or truck engine. Of course, many other strap configurations could be used within the scope of the disclosure and claims herein. For example, the protrusions could be square or rectangular similar to the notches. The notches could be on a portion of the strap and not on the entire strap. In addition, the strap could be a metal chain. In the case of a metal chain, the space in a link between pins may be considered a notch, and all the foregoing discussion applies to embodiments that use a metal chain for a strap. The disclosure and claims herein expressly extend to any continuous loop strap that has a plurality of notches, regardless of the particular geometric configuration, shape, size or number of the notches on the strap, or the particular material of which the strap is made.

Strap wrench 100 also includes a mechanism for adjusting the size of the loop in the strap that is external to the handles. For the specific configuration shown in FIGS. 1 and 2, the adjustment mechanism is a wheel 140 and a plurality of slots 150. The wheel 140 is shown in detail at the bottom of FIG. 2, where the lower view is a side view of the upper view along the line 2-2. Wheel 140 includes shaft portions 210 that are dimensioned to fit within the plurality of slots 150. When the strap wrench is assembled, the lower portion of handle 130 is separated from the upper portion until the shaft portions 210 of the wheel 140 are received into the plurality of slots 150. Note the plurality of slots 150 exist in both the upper portion and the lower portion of handle 130. In this manner the wheel, once installed into the plurality of slots, moves freely within the plurality of slots, with the strap 110 going around wheel 140. The wheel 140 may be moved within the slots 150 because the shaft portions 210 are preferably longer than the thickness of the material for slots 150, causing shaft portions 210 to extend above and below handle 130. A person may thus move the wheel 140 by moving the shaft portions 210 within the slots 150 using his or her fingers. Moving the wheel 140 up increases the size of the loop in the strap external to the handles. Moving the wheel 140 down decreases the size of the loop in the strap external to the handles.

When a person uses the strap wrench 100 to turn an object, the wheel 140 will typically be moved to one of the upper positions (towards the loop in the strap) in the slots 150 to make the loop in the strap larger than the object to be turned. The loop is placed over the object to be turned, and the user then moves the wheel 140 downward until the loop tightens around the object to be turned. Once the loop is as tight as possible, the user moves the wheel 140 into the slot the farthest to the bottom where it will fit. This provides a coarse adjustment and tightening of the strap. Once the wheel is in the appropriate slot to make the loop snug around the object to be turned with the handles in the open position as shown in FIG. 1, the handles may then be moved to the closed position by squeezing on the handles until the locking mechanisms 126 and 136 engage each other (see FIGS. 3 and 4). By squeezing the handles together until they are locked, the rollers 122 and 132 in FIG. 1 exert a squeezing force on the strap 110, causing the strap to further tighten on the object to be turned. Once the handles are locked together, the strap wrench 100 in FIG. 1 may exert a force in a counter-clockwise direction on the object to be turned because stop member 138 will prevent the strap from traveling in direction 500 as shown in FIG. 5. If needed, the strap wrench, after traveling some distance in the counter-clockwise direction, may be ratcheted back in the clockwise direction to the starting point. When moving in the clockwise direction, the stop member will bend over the protrusions of the strap, as shown in FIG. 6. The combination of a continuous loop strap and a ratchet mechanism provide a strap wrench that provides a ratcheting action after the strap wrench has been tightened over an object to be turned. Known strap wrenches do not provide the ability to ratchet the handle while keeping the strap tight.

Figure 7:
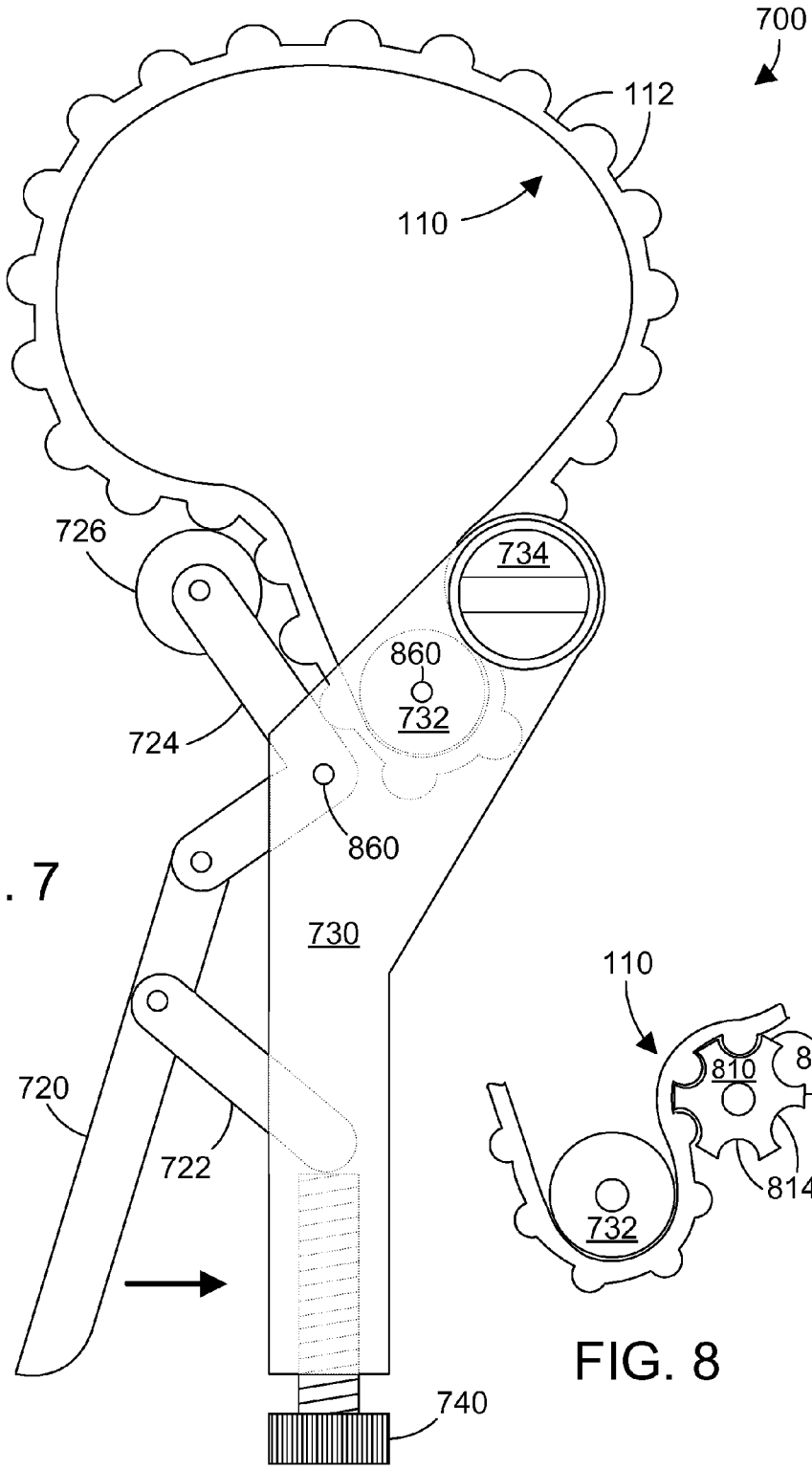
FIG. 7 is a front view of a second implementation of a strap wrench.
Figure 8:
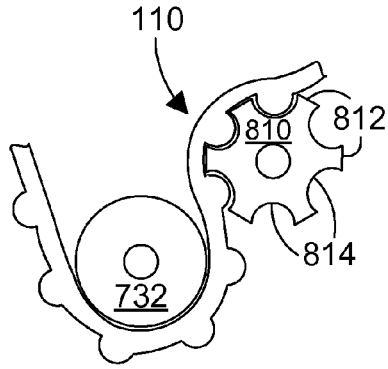
FIG. 8 is a detailed view showing the strap inside the handle 730 in FIG. 7.
Figure 9:
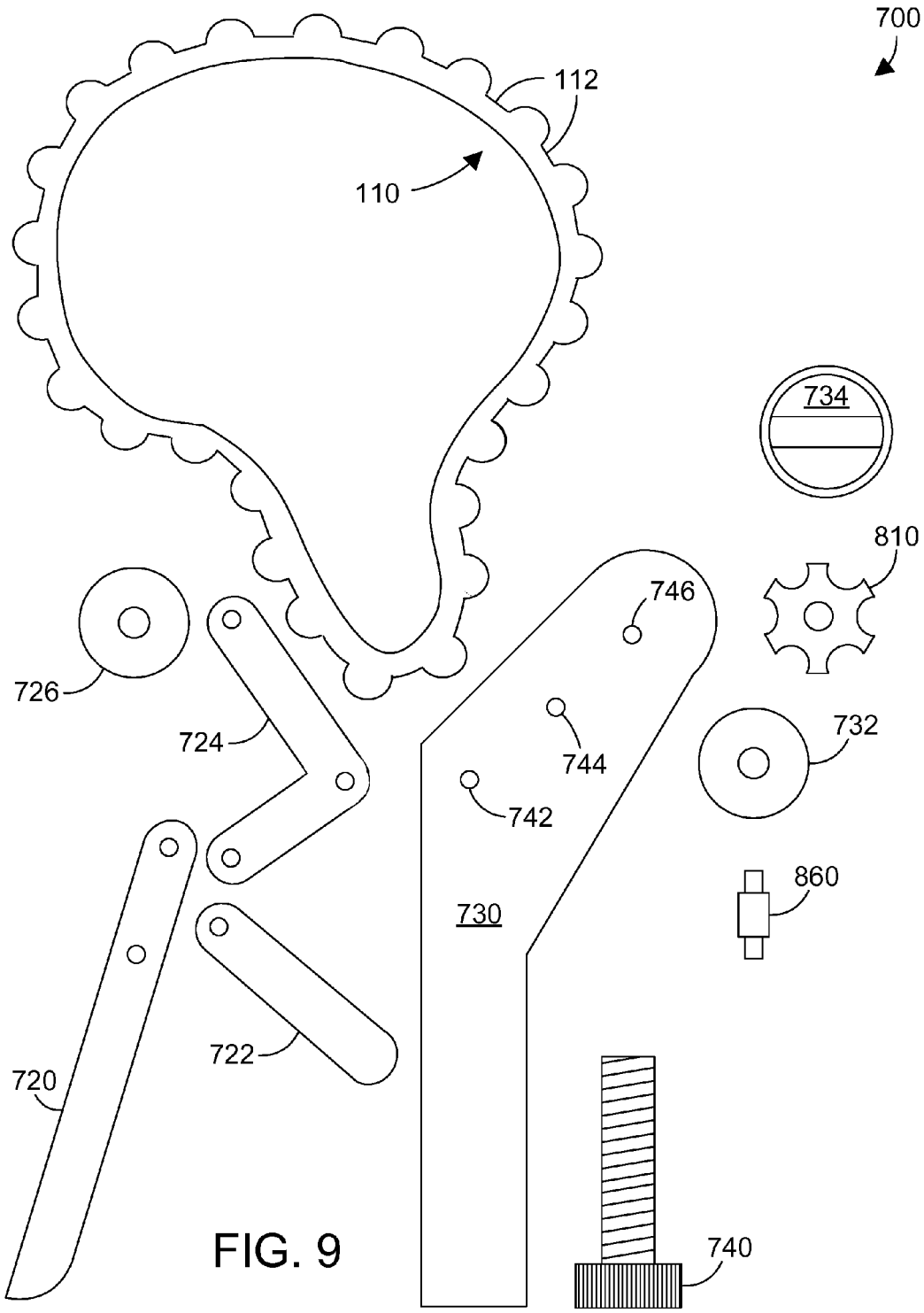
FIG. 9 is an exploded front view of the strap wrench shown in FIG. 8 showing the various components.

A second implementation 700 of the strap wrench is shown in FIGS. 7-9. This implementation is in a locking pliers configuration. Note some of the components in FIG. 8 that are internal to the strap wrench are shown in phantom. Strap wrench 700 includes a strap 110 that is a continuous loop having a plurality of notches 112. A first handle 730 includes a wheel 732 internal to the handle, around which the inside of strap 110 passes. Handle 730 also includes a ratchet head with a ratchet knob 734. This ratchet head is similar to known ratchet heads used in ratchets for socket wrenches. The ratchet knob 734 thus allows rotation of the ratchet head in one direction, while preventing rotation of the ratchet head in the opposite direction. The ratchet knob 734 may be rotated to change the direction of the ratchet head operation. The details of the ratchet head are not disclosed because they are well-known in the art.

The ratchet head underneath ratchet knob 734 drives a sprocket 810 shown in FIG. 8. The sprocket 810 includes extending portions 812 that fit within the plurality of notches 112 of strap 110, and recessed portions 814 that receive the protrusions between notches. The position of wheel 732 provides a tight fit between the strap 110 and the sprocket 810. The ratchet head allows the sprocket 810 to rotate in a first direction while preventing rotation in a second direction opposite the first direction when the ratchet knob 734 is in a first position, and allows the sprocket 810 to rotate in the second direction while preventing rotation in the first direction when the ratchet knob 734 is in a second position. This allows changing direction of the ratcheting action without turning the wrench over, as discussed above with respect to strap wrench 100 in FIGS. 1-6.

A second handle 720 is pivotally coupled to a first member 722 and an L-shaped member 724 as shown. The first member 722 contacts an adjustment screw 740 that allows adjusting the size of the loop in strap 110. By turning the adjustment screw 740 in a first direction, the adjustment screw 740 moves up in handle 730. By turning the adjustment screw 740 in a second direction opposite the first direction, the adjustment screw 740 moves down in handle 730.

The L-shaped member 724 is pivotally coupled to the handle 730 using a spacer member 860 shown in FIG. 9. The L-shaped member is also coupled to a wheel 726 as shown in FIG. 7. When the handle 720 is moved towards handle 730 as shown by the arrow in FIG. 7, the L-shaped member pivots about spacer member 860, causing the wheel 726 to press upon and move the strap 110. This is the mechanism for tightening the strap 110 around an object to be turned. Thus, a person first moves the handles to an open position, then loosens the adjustment screw 740 until the loop in strap 110 is sufficiently large to put around the object to be turned. Once the strap is surrounding the object to be turned, the adjustment screw 740 could be tightened until the loop tightens around the object to be turned, thus providing a coarse adjustment of the strap wrench. Next, the handles 720 and 730 would be placed in a closed position by moving the handle 720 relative to handle 730 as shown by the arrow in FIG. 7 until the handle 720 locks into place in a closed position. This action is similar to known locking pliers, where the handles are locked together by squeezing the handles together. At this point, the strap is securely tightened around the object to be turned. The person may then move the ratchet knob 734 to the desired position to inhibit rotation of the strap in a first direction while allowing rotation of the strap in a second direction. In this manner, the locking pliers configuration 700 for the strap wrench allows easily tightening the strap around an object to be turned, and provides a ratchet mechanism for turning the wrench with respect to the strap.

Spacer member 860 is preferably used in each of the three holes 742, 744 and 746 in handle 730 shown in FIG. 9. The spacer member 860 installed at hole 742 provides a pivotal coupling between the L-shaped member 724 and handle 730. The spacer member 860 installed at hole 744 provides a rotational coupling between wheel 732 and handle 730. The spacer member 860 installed at hole 746 provides a rotational coupling between sprocket 810 and handle 730.

The strap wrench 700 may effectively be used as an oil filter wrench. The locking pliers design allows the adjustment screw 740 to be moved to provide a loop in the strap external to the handles that will receive an oil filter. Once the loop in the strap is placed around an oil filter, the adjustment screw 740 may be adjusted, as needed, to provide a somewhat snug fitting of the strap onto the object to be turned. Once the handles are squeezed together and locked into place, the strap is tightly secured around the object to be turned. A force on the handles may then be exerted to turn the oil filter. If the strap wrench runs into part of the engine while rotating, the strap wrench may be ratcheted back to the original position while the handles are still in the closed and locked position. This ratcheting function may be repeated until the oil filter has been sufficiently turned. The combination of a continuous loop strap and a ratchet mechanism provide a ratcheting function to a strap wrench after the strap is securely tightened, which is a vast improvement over known strap wrenches and oil filter wrenches.

Figure 10:
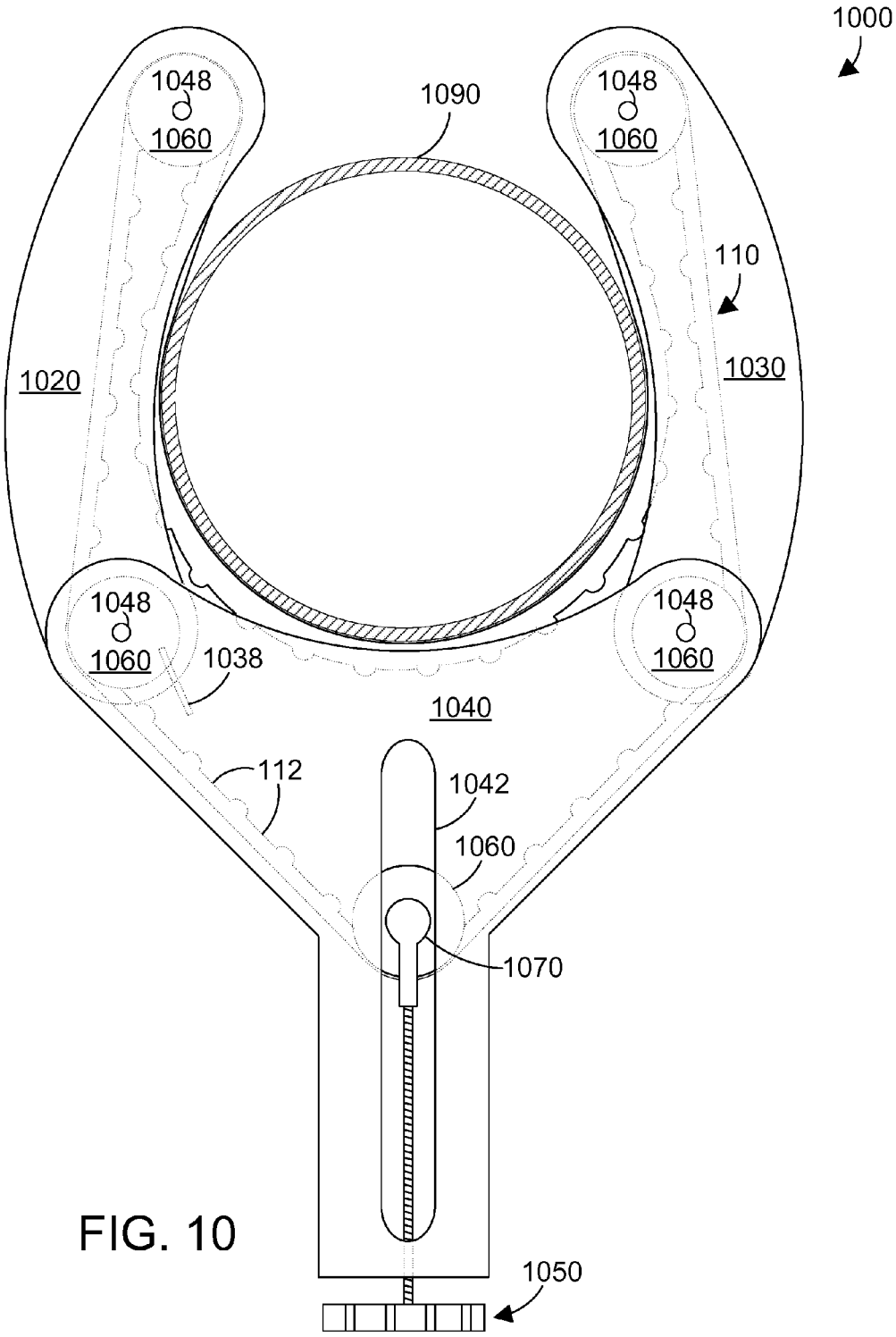
FIG. 10 is a front view of a third implementation of a strap wrench.
Figure 11:
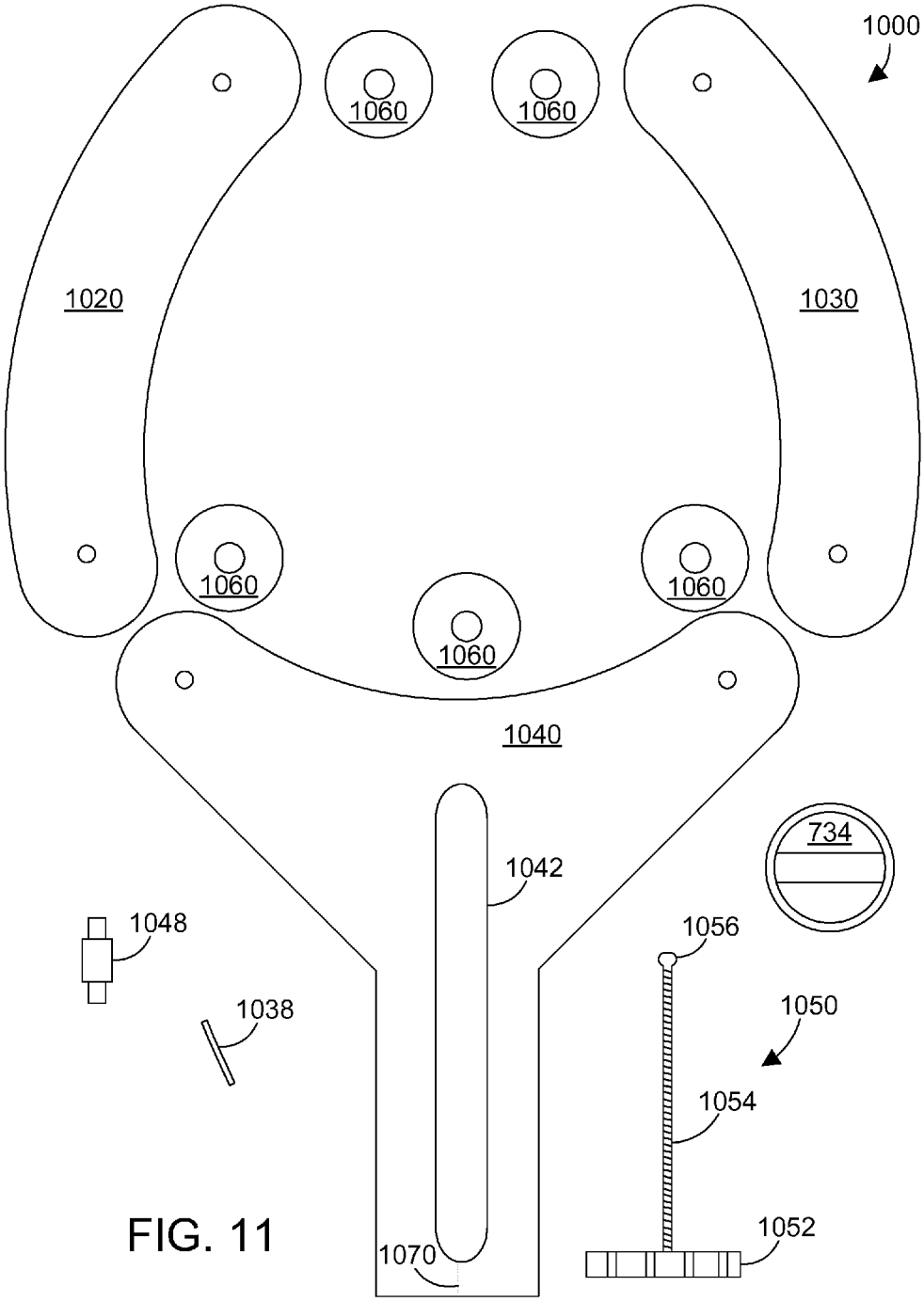
FIG. 11 is an exploded front view of the strap wrench shown in FIG. 10 showing many of the various components.
Figure 12:
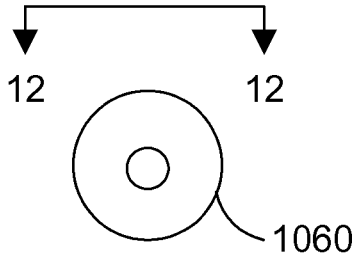
FIGS. 12-14 are different views of the sprocket 1060 shown in FIGS. 10 and 11.
Figure 13:
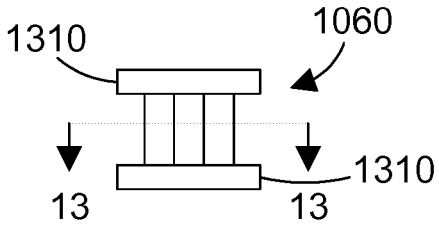
Figure 14:
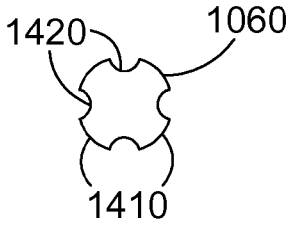

A third implementation 1000 for a strap wrench is shown in FIGS. 10-16. Once again, items that are internal to the strap wrench 1000 are shown in FIG. 10 in phantom for the sake of clarity. A strap 110 is a continuous loop that includes a plurality of notches 112. While the strap 110 is not shown separately in FIGS. 11-16, the entire strap is visible in phantom in FIG. 10. The third implementation 1000 is different than the first two implementations disclosed herein because it can be placed around an object to be turned without placing the loop of the strap around an end of the object to be turned. Thus, the strap wrench 1000 may be used to turn objects that do not have an end around which a loop in a strap may be placed, such as a metal pipe that has fittings at both ends. Strap wrench 1000 includes a base portion 1040 and two arms 1020 and 1030 that are pivotally coupled to the base portion 1040. Five sprockets 1060 are provided around which the strap 100 passes. Details of the sprockets 1060 are shown in FIGS. 12-14. FIG. 12 is a top view of sprocket 160, while FIG. 13 is a side view along the line 12-12 in FIG. 12, and FIG. 14 is a cross-sectional view of the internal portion of sprocket 1060 taken along the line 13-13 in FIG. 13. The sprocket 1060 includes a plurality of extending portions 1410 and a plurality of recessed portions 1420 that engage the notches 112 and protrusions on the strap, respectively. Note the sprocket 1060 preferably includes upper and lower shoulders 1310 shown in FIG. 13, with the strap running between the shoulders. The shoulders 1310 on the sprockets 1060 prevent the strap from contacting the interior surface of the arms 1020 and 1030 and the base 1040, thereby minimizing friction on the side of the strap as the strap wrench is used Note that the sprocket 1060 at the bottom-most position in the base portion 1040 is attached to a tension mechanism 1050 that allows tightening and loosening the strap. Part of the tension mechanism 1050 is a tension block 1070 that is attached to the sprocket 1060 so that turning the adjustment knob 1052 on the tension mechanism 1050 (see FIG. 11) in a first direction causes the sprocket 1060 to move up in slot 1042, while turning the adjustment knob 1052 on the tension mechanism 1050 in a second direction opposite the first direction causes the sprocket 1060 to move down in slot 1042. In this manner the tension on the strap 110 may be adjusted as needed using the tension mechanism 1050 by turning the adjustment knob 1052.

The tension mechanism 1050 includes the tension block 1070, an externally threaded shaft 1054, an enlarged end portion 1056, and an adjustment knob 1052 as shown in FIG. 11. The externally threaded shaft engages threads in an internally threaded hole 1070 shown in FIG. 11. In this manner the shaft 1054 moves up or down in the threaded hole 170 depending on the direction the knob 1052 is turned, causing the tension block 1070 to move up or down accordingly in the slot 1042.

Figure 15:
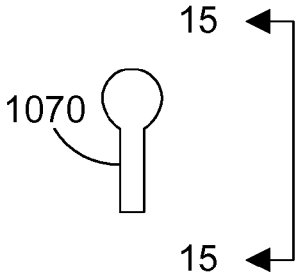
FIGS. 15 and 16 are different views of the tension block 1070 shown in FIG. 10.
Figure 16:
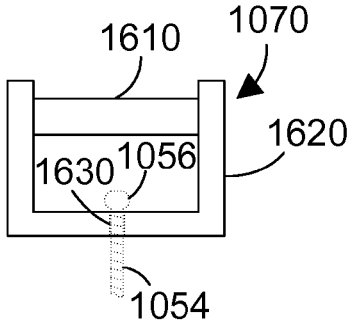

Details of the tension block are shown in FIGS. 15 and 16. FIG. 16 is a side view of the tension block 1070 along the line 15-15 shown in FIG. 15. The tension block 1070 includes a shaft 1610 that passes through the center of the sprocket 1060, and a U-shaped frame portion 1620 coupled to the shaft 1610. The U-shaped frame portion includes an unthreaded hole 1630 through which the threaded shaft 1054 of the tension mechanism 1050 is passed, as shown in phantom in FIG. 16. The enlarged end portion 1056 of the shaft 1054 is shown larger than hole 1630, which causes the shaft to rotate freely within the hole 1630, and captivates the tension block 1070 onto shaft 1054. The tension mechanism 1050 could be assembled by placing the end of the threaded shaft 1054 opposite the enlarged end portion 1056 through the hole 1630, then screwing the threaded shaft 1054 into the threaded hole 1070 shown in FIG. 11. Once the threaded shaft 1054 is a sufficient distance outside of base portion 1040, the knob 1052 could be attached to the threaded shaft 1054 using any suitable mechanism, such as threads, glue, welding, a set screw, etc.

The strap wrench 1000 preferably includes a ratchet mechanism that allows rotation of the strap wrench 1000 about the strap 110 in a first direction, but inhibits rotation of the strap wrench 1000 in a second direction opposite the first direction. The ratchet mechanism may be any known ratchet mechanism, or may be either of those disclosed with respect to the other implementations 100 and 700 discussed above. Thus, FIGS. 10 and 11 show a stop member 1038 that is positioned at an angle to engage a recess 1420 (see FIG. 14) in the sprocket 1060 to allow rotation in a first direction while inhibiting rotation in a second direction opposite the first direction. In the alternative, a ratchet head with a ratchet knob 734 shown in FIG. 11 could be placed on any of the sprockets 1060 to allow rotation in a first direction while inhibiting rotation in the opposite direction.

To use the strap wrench 1000, a person first loosens the adjustment knob 1052 on tension mechanism 1050 until the arms 1020 and 1030 may be pivoted away from each other a sufficient distance to receive the object to be turned. In FIG. 10, the object to be turned is a metal pipe 1090. Once the arms 1020 and 1030 are placed around the object to be turned, the adjustment knob 1052 on the tension adjustment mechanism 1050 is turned to tighten the strap around the object to be turned. Note the arcuate configuration of the arms 1020 and 1030 result in the arms being tightened around the object to be turned 1090 as the strap is tightened. Once the strap is sufficiently tightened, the strap wrench 1000 may be rotated in a first direction, while rotation is inhibited in a second direction opposite the first direction, thereby providing ratcheting action for the strap wrench 1000 after the strap 110 is tightened into place.

The left arm 1020 preferably includes two identical pieces shown in FIG. 11 that are constructed with the sprockets 1060 between them using spacer 1048 such that the sprockets 1060 rotate freely. The right arm 1020 is constructed in a similar manner of two identical pieces with the sprockets 1060 between them using spacer 1048. The base portion 140 is preferably made from a single piece that has a top and bottom identical to that shown as 140 in FIG. 11, connected by a bottom portion that contains threaded hole 1070. Note that base portion 140 may include other features not shown, such as sides on the portions surrounding the tension mechanism 1050, a rubber hand grip, etc.

Note the strap in FIG. 10 could be inverted so the notches are facing the pipe 1090 instead of the smooth back portion of the strap facing the pipe. In this inverted strap configuration, items 1060 are smooth wheels instead of sprockets.

The strap wrenches disclosed herein may be made of any suitable material or combination of materials, such as plastic, metal, composite materials, wood, etc. The various different components may be fabricated using any suitable method, including without limitation casting, stamping, injection molding, die cutting, machining, etc. In addition, the strap wrenches disclosed herein may be made in any suitable size according to specific needs. Thus, a very small strap wrench could be used for a specific application where a small object needs to be turned, and a very large strap wrench could be used for a different application where a very large object needs to be turned. Thus, the specific implementations for the strap wrench shown herein may be scaled up or down as needed. In addition, the strap wrench disclosed herein need not be hand-held and hand-operated. For example, a very large strap wrench similar to the configuration in FIGS. 10-16 could be used mounted to a large piece of machinery for turning a pipe that is ten meters in diameter.

All of the three different implementations for a strap wrench disclosed herein have some common features. All include a strap that is a continuous loop having a plurality of notches. All include a ratchet mechanism that allows rotation of the strap wrench in one direction while inhibiting rotation of the strap wrench in the opposite direction. This combination of features provides strap wrenches in various configurations that may be used in a ratcheting fashion after the strap is tightened around an object to be turned. Nowhere does any known strap wrench include a strap that is a continuous loop with a ratchet mechanism. Many other configurations and implementations not expressly shown herein are possible, and all are within the scope of the disclosure and claims herein.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. A strap wrench comprising:

a strap in a continuous loop having a plurality of notches; and a tension mechanism for tightening the strap around an object to be turned using the strap wrench, wherein the tension mechanism comprises:

a first handle having a first roller disposed to contact the strap; and a second handle pivotally coupled to the first handle having a second roller disposed to contact the strap, the first and second rollers being separated by a first distance when the first and second handles are in an open position and being separated by a second distance that is less than the first distance when the first and second handles are in a closed position; and wherein the strap forms an opening external to the first and second handles for receiving the object to be turned, and the tension mechanism tightens the strap around the object to be turned when the first and second handles are in the closed position and loosens the strap around the object to be turned when the first and second handles are in the open position.

2. The strap wrench of claim 1 further comprising a ratchet mechanism that engages at least one of the plurality of notches on the strap.

3. The strap wrench of claim 2 wherein the ratchet mechanism comprises a sprocket having a plurality of extending portions that engage at least one of the plurality of notches on the strap.

4. The strap wrench of claim 3 wherein the ratchet mechanism further comprises a knob coupled to the sprocket that allows changing direction of operation of the ratchet mechanism by turning the knob.

5. The strap wrench of claim 1 further comprising a locking mechanism for coupling the first handle to the second handle in the closed position.

6. The strap wrench of claim 1 further comprising an adjustment mechanism for adjusting size of the opening in the strap external to the first and second handles.

7. A strap wrench comprising:

a strap in a continuous loop having a plurality of notches;

a tension mechanism for tightening the strap around an object to be turned using the strap wrench;

first and second handles, wherein the strap forms an opening external to the first and second handles for receiving the object to be turned, and the tension mechanism tightens the strap around the object to be turned when the first and second handles are in a closed position and loosens the strap around the object to be turned when the first and second handles are in an open position; and a ratchet mechanism that engages at least one of the plurality of notches on the strap, allowing movement of the strap wrench along the strap in a first direction and preventing movement of the strap wrench along the strap in a second direction opposite the first direction.

8. The strap wrench of claim 7 further comprising a first handle having a first roller disposed to contact the strap and a second handle pivotally coupled to the first handle having a second roller disposed to contact the strap, the first and second rollers being separated by a first distance when the first and second handles are in an open position and being separated by a second distance that is less than the first distance when the first and second handles are in a closed position.

9. The strap wrench of claim 8 further comprising a locking mechanism for coupling the first handle to the second handle in the closed position.

10. The strap wrench of claim 8 further comprising an adjustment mechanism for adjusting size of the opening in the strap external to the first and second handles.

11. The strap wrench of claim 7 wherein the ratchet mechanism comprises a sprocket having a plurality of extending portions that engage at least one of the plurality of notches on the strap.

12. The strap wrench of claim 11 wherein the ratchet mechanism comprises a knob coupled to the sprocket that allows changing direction of operation of the ratchet mechanism by turning the knob.

13. A strap wrench comprising:

a strap in a continuous loop having a plurality of notches;

a first handle having a first roller disposed to contact the strap;

a second handle pivotally coupled to the first handle having a second roller disposed to contact the strap, the first and second rollers being separated by a first distance when the first and second handles are in an open position and being separated by a second distance that is less than the first distance when the first and second handles are in a closed position;

wherein the strap forms an opening external to the first and second handles for receiving an object to be turned, and the strap is tightened around the object to be turned when the first and second handles are in the closed position and loosens the strap around the object to be turned when the first and second handles are in the open position;

a locking mechanism for coupling the first handle to the second handle in the closed position;

an adjustment mechanism for adjusting size of the opening in the strap external to the first and second handles; and a ratchet mechanism that engages at least one of the plurality of notches on the strap, allowing movement of the strap wrench along the strap in a first direction and preventing movement of the strap wrench along the strap in a second direction opposite the first direction.

* * * * *